US005836525A

United States Patent [19]

Garnier et al.

[11] Patent Number: 5,836,525

[45] Date of Patent: Nov. 17, 1998

[54] LINING FOR A REFINER

[75] Inventors: Yves Garnier, Grenoble; Guy Caucal, Montchaboud, both of France

[73] Assignee: A.R.T.E. Parc Equation, Gieres, France

[21] Appl. No.: 721,992

[22] PCT Filed: Apr. 7, 1995

[86] PCT No.: PCT/FR95/00452

§ 371 Date: Jan. 31, 1997

§ 102(e) Date: Jan. 31, 1997

[87] PCT Pub. No.: WO95/27822

PCT Pub. Date: Oct. 19, 1995

[30] Foreign Application Priority Data

Apr. 8, 1994 [FR] France ..... 94 04667

[51] Int. Cl.[6] ..... B02C 7/12

[52] U.S. Cl. ..... 241/28; 241/261.2; 241/296; 241/300; 427/446

[58] Field of Search ..... 241/300, 296, 241/297, 298, 28, 261.2, 261.3, 30; 427/446

[56] References Cited

U.S. PATENT DOCUMENTS

| | | | |
|---|---|---|---|
| 3,104,837 | 9/1963 | Steiniger et al. | 241/296 |
| 3,462,089 | 8/1969 | Whitlow | 241/296 |
| 4,061,283 | 12/1977 | Kahmann | 241/296 |
| 4,372,495 | 2/1983 | Marton et al. | 241/28 |
| 4,423,845 | 1/1984 | Frazier et al. | 241/298 |
| 4,951,888 | 8/1990 | Sharpe et al. | 241/296 |
| 5,039,022 | 8/1991 | Wilssua | 241/296 |
| 5,046,672 | 9/1991 | Demler | 241/296 |
| 5,580,472 | 12/1996 | Maybon | 241/296 |

FOREIGN PATENT DOCUMENTS

| | | |
|---|---|---|
| 0480851 | 4/1992 | European Pat. Off. . |
| 1621703 | 10/1969 | Germany . |
| WO91/02841 | 3/1991 | WIPO . |

OTHER PUBLICATIONS

M. Sferrazza, "Proper Refiner Selection, Upkeep Boosts Performance and Savings", *Issue* Focus: Mill Maintenance I.

*Primary Examiner*—Mark Rosenbaum
*Attorney, Agent, or Firm*—Millen, White, Zelano & Branigan, P.C.

[57] ABSTRACT

A component for a pulp refiner such as a paper pulp refiner. The component comprises an attachment surface (16) for attachment to the refiner, a working surface (17, 22), and at least one core (15, 28, 33, 50, 51) made of rigid material and provided with a wear resistant coating (19, 20, 25) so that at least the useful surface area (18) of the component at least partially consists of the outer surface of the coating (19, 20, 25). Said component is characterised in that said coating (19, 20, 25) consists of a stack of thin layers or strips (21). A refiner including at least one such component, a method for preparing said component and a fiberising and for refining method using at least one such component are also disclosed.

19 Claims, 12 Drawing Sheets

LINING FOR A REFINER

The invention relates to a filling for a pulp refiner such as a refiner for paper pulp, to a refiner including at least one such lining, to a process for the preparation of this filling and to a refining process in which at least one such filling is employed.

STATE OF THE ART

It is known to perform the refining of pulps such as paper pulps by passing them through a refiner. Refiners for paper pulp are fitted with a rotor and a stator between which the raw material is defibered and fibrillated. There are two main categories of refiners: disc refiners and conical refiners.

Disc refiners generally include one or more rotors and one or more stators, each consisting of a support disc on which another disc, called a refining disc is fitted, the function of which is, at the same time, to protect the support disc from erosion by the raw material to be refined and to participate in the refining of the latter.

During the refining the raw material can be introduced via the centre of at least one of the refining discs into the space situated between the two refining discs and can flow towards their periphery. It can also be introduced at the periphery of the discs and come out at the centre of the discs. In the course of either of these circulations the pulp undergoes a treatment which considerably modifies the physical properties of the fibres present in the pulp and subsequently enables the paper manufactured from the treated pulp to have the characteristics that are necessary for the use for which it is destined.

As shown in FIGS. 1 and 2, the refining discs generally comprise a face 1 for securing to the refiner and a working face 2 including an alternation of grooves 3 and of projections, called blades 4. The active surface 5 of these blades 4 wears away gradually during the refining, with the result that the refiner must be stopped at regular intervals and the refining discs must be replaced.

Refining discs which are currently employed are either discs which have a complete annular shape and which are cast as a single component, like a torus-shaped member (FIG. 1), or discs, illustrated in FIG. 3, which are made up of a number of segments 6 and which together form a ring.

Conical refiners generally include a rotor 7, shown in FIGS. 4 and 5, of conical or frustoconical shape, and a stator 8, shown in FIGS. 6 and 7, also of conical or frustoconical shape. Refining cones or conical frustums 9 and 10 are fitted, respectively, on the external surface 11 of the rotor 7 and on the internal surface 12 of the stator 8. These refining cones or conical frustums 9, 10 may be made up of segments 13, 14 respectively. They comprise an alternation of grooves and blades (not shown) and play the same part as the refining discs referred to above.

During refining in a conical refiner the raw material is introduced between the stator and the rotor of the refiner, at the top of the cone or conical frustum forming the rotor and comes out at the base of this same cone or conical frustum.

Given that the refining discs or cones must resist wear, they are generally made of a metal or of a metal alloy which exhibits a high hardness.

In order to improve the effectiveness of refining of paper pulp which is carried out with the aid of such metal discs or cones, research which is at present being carried out deals with the modification of the geometry of their working face and with the nature of the metal or metal alloy.

Thus, International Application No. WO 90/04673 proposes a process for the manufacture of fibre pulp in which a starting material containing lignocellulose is defibered and fibrillated between the blades of two grinding discs facing each other and, according to which, in order to improve the refining, the blades have been inclined at an angle of 5 to 30 degrees relative to the radius of the discs on which these blades are situated.

However, this process still does not enable the quality of the pulp obtained to be improved sufficiently.

In the course of its investigations the Applicant Company found that the quality of the refining was limited by the nature of the material of which the discs were made, that is to say by the metal or the metal alloy, and that in order to improve the refining of the pulp it would be advantageous if resorting to metal active surfaces could be dispensed with.

In fact, when the refining is done with the aid of metal discs, impacts take place between the rotor disc and the stator disc, during which metal particles are torn from the disc blades. As a result, the active surface 5 of the blades 4 becomes very nonuniform and reduces the fibrillation of the paper fibres, and this lowers the quality of the refining.

In addition, since the metal discs wear rapidly, the quality of the refined pulp is not uniform in time and stoppages of the refiner, which are needed for replacing the worn discs with new metal discs, are frequent. Since the worn discs cannot be regenerated, they must therefore be discarded.

In the state of the art there is therefore no possibility of refining which makes it possible to obtain a high and uniform quality of the refined pulp and which reduces the frequency of the refiner stoppages that are necessary for changing the refining discs. Nor is there a refining disc that exhibits a high resistance to wear, or a regenerable nature with an acceptable cost of regeneration.

SUMMARY DESCRIPTION OF THE INVENTION

While carrying out its research in a new direction, the Applicant Company has successfully developed a filling overcoming the disadvantages linked with the metal discs of the state of the art. This filling comprises a face for securing to the refiner, a working face, at least one core made of a rigid material and covered with a coating made of a wear-resistant material, so that at least the active surface of the filling consists of all or a portion of the external surface of the said coating and differs from the fillings of the state of the art in that the said coating consists of an overlay of thin layers or lamellae.

Such a filling exhibits a wear resistance that is superior to the fillings known hitherto.

In addition, it may include a core consisting of an inexpensive rigid material such as a recovered material.

Moreover, it can be regenerated anew by the application of a new coating once the coating is worn.

Furthermore, when it is used in a refiner, and at the same specific energy consumption, the refined pulp obtained has a mean fibre length and a brightness which are superior to those of the pulps obtained in a refiner provided with fillings according to the state of the art. A reduction in noise is also observed during the refining and a greater stability of the gap (distance between the rotor and the stator) of the refiner, and this is reflected in a greater uniformity in the properties of the refined pulp.

Other advantages provided by the filling according to the invention and its use will appear on reading the detailed description which follows, and on examining FIGS. 8 to 27, which are given merely by way of illustration.

SUMMARY DESCRIPTION OF THE FIGURES

Figure 1:
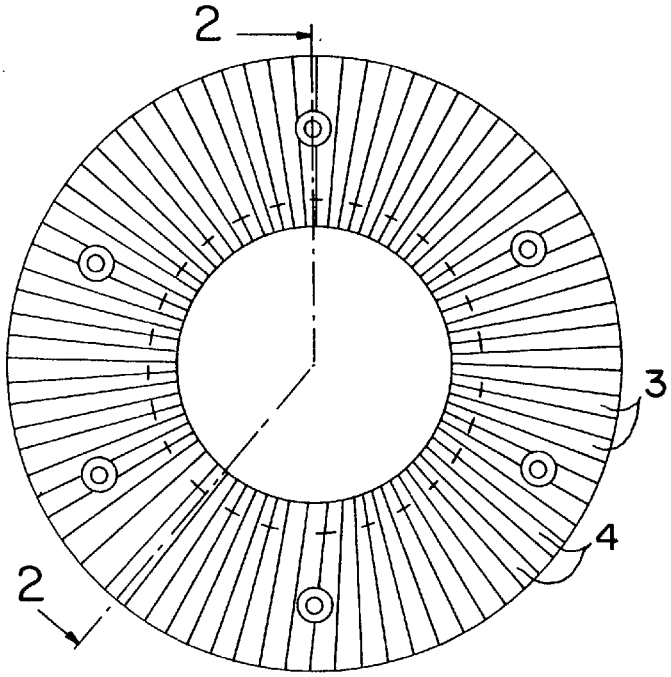
FIG. 1 PRIOR ART
FIGS. 1 and 2 show diagrammatically a refining disc according to the state of the art, seen in front view and in side view in section according to the axis 2—2 respectively.
Figure 2:
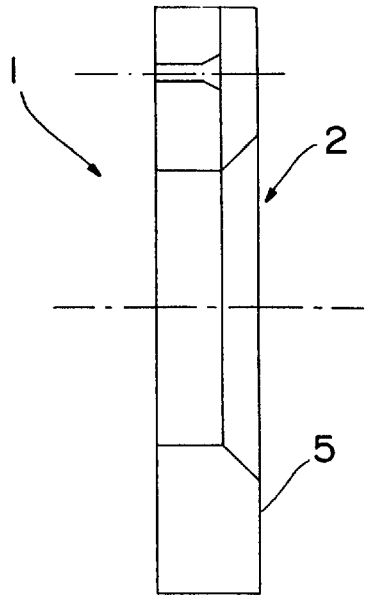
FIG. 2 PRIOR ART

For the sake of clarity, FIGS. 9, 10, 12, 13, 14, 16, 17, 18, 20 and 21 have not been hatched, although they represent sections.

DETAILED DESCRIPTION OF THE INVENTION

The securing face and the working face of a filling according to the invention are, respectively, the face intended to be secured against the support disc or cone of the refiner, and the face directly involved where the pulp is being refined.

These faces are preferably parallel when the filling is intended to be employed on a disc refiner, and concentric when the filling is intended to be used on a conical refiner.

In the description of the invention an active surface is intended to mean only the surface of the filling which is furthest away from the securing face and against which the pulp will be refined (fibrillated). The active surface may occupy the whole working face of the filling: this is the case in particular when the working face is planar. The active surface may also represent only a portion of the working face, for example when the latter comprises places, such as grooves, where the pulp is not fibrillated.

The active surface of a filling according to the invention always consists of all or a portion of the external surface of the coating.

An external surface of the coating is intended to mean the surface which is away from the surface of the coating in contact with the core. According to the invention the external surface of the coating therefore always includes at least the active surface of the filling. In other words, the active surface always consists of the wear-resistant material of which the coating is made. On the other hand, the extent of the external surface of the coating need not to be limited to the active surface of the filling.

As a general rule—though this is not essential—the coating is present only on the working face, which it therefore occupies at least partially. This coating is preferably continuous and of uniform thickness over the whole active surface. Its thickness is generally between 0.1 and 2 mm, preferably between 0.5 and 0.8 mm.

The rigid material of which the core of the filling is made is a material which has mechanical properties, especially compressive strength, enabling it not to shatter when the rotor and the stator are brought near each other, and not to break away and be carried off by the flow of the raw material being refined. It may be a metal, a metal alloy, cast iron, a plastic which has good mechanical characteristics, especially a sufficient shear strength, such as the so-called "high performance" plastics, among which there may be mentioned polyamides 4–6, polyamideimides or technical polymers such as polyamide 6—6. The rigid material may also be a composite material such as epoxy/carbon fibres, epoxy/glass fibres or vinyl ester/carbon fibres. It is obvious that the choice of rigid material is also a function of its resistance to the process chosen for applying the coating.

An advantage of the lining according to the invention is that the rigid material may be an inexpensive recovered material such as a recovered metal or metal alloy or a plastic produced from recycled polymers exhibiting the mechanical characteristics referred to above. In fact, in contrast to the fillings of the state of the art, which must necessarily be manufactured with materials exhibiting a high wear resistance, such as steel or cast iron, the fillings according to the invention may include a core consisting of a material that is not very resistant to wear because the core does not have any active surface and wear resistance is not its purpose.

In addition, it is possible to choose a material exhibiting a high resilience (impact strength) as rigid material and a material which has low resilience but which has a high hardness, as coating. The filling obtained is then not very brittle while giving very good performance.

The wear-resistant material forming the coating is preferably a material that is different from that from which the core is made. It must be capable of adhering to the latter with sufficient firmness not to be torn away and carried away by the stream of raw material during the refining. It may be a pure metal such as molybdenum (Mo), nickel (Ni), aluminium (Al), copper (Cu), tantalum (Ta) or titanium (Ti), a metal alloy such as nickel-chromium (NiCr), nickel-chromiumaluminium-yttrium (NiCrAlY), nickel-chromium-iron-boronsilicon (NiCrFeBSi), nickel-aluminium (NiAl) or copper-aluminium (CuAl), a pseudoalloy such as aluminium-molybdenum (Al—Mo) or copper-tungsten (Cu—W), a cermet such as WC—Co, $Cr_3C_2$—NiCr, WC—Ni or WC—NiCr, a ceramic such as alumina ($Al_2O_3$), chromium oxide ($Cr_2O_3$), titanium oxide ($TiO_2$), zirconia ($ZrO_2$), zirconium and yttrium oxide ($ZrO_2/Y_2O_3$), yttrium barium copper oxide ($Y_1Ba_2Cu_3O_7$) or silica ($SiO_2$), a mineral such as apatite, a carbide such as tungsten, titanium, boron or silicon carbide or an adamantine carbon.

Provision may also be made for the coating to be a mixture of these materials or an overlay of layers consisting of different materials chosen from these materials.

A ceramic, in particular alumina, is preferably employed as coating.

It is preferable to use a porous coating. The characteristics of the refined pulp are thus improved. A porous coating is to be understood as a coating in which the ratio total volume of the pores/total volume of the coating is between 2% and 50%, preferably between 10% and 30%.

The Applicant Company has, in fact, been surprised to discover that it is possible to employ a material that has high porosity for the coating because, in general, when attempts are made to increase the wear resistance of a component, it is coated with a layer of a material which has a porosity that is as low as possible.

It is furthermore desirable that the porosity should increase from the surface of the coating in contact with the core as far as the active surface. Such a porosity gradient permits, at the same time, a good adherence of the coating to the core and better refining of the pulp. The porosity may thus be nil in contact with the core and close to 50% at the active surface.

The porosity is advantageously of the open type. In fact, this seems to produce a capillarity effect with regard to the water present in the pulp being refined and to modify beneficially the circulation of the pulp and its refining.

It is found advantageous to employ as coating a material which has good tribological characteristics and/or a high abrasiveness towards the material to be refined.

The coating may include a second material placed between the wear-resistant material and the core, so as to cover the latter and to protect it against corrosion by the raw material to be refined which could pass through the coating if this coating is porous. This is found to be particularly advantageous when, for example, the core is made of an oxidizable metal or alloy.

The said second material is preferably in the form of a thin layer, of thickness preferably between approximately 20 and approximately 200 microns (micrometres, $\mu$m) and preferably between approximately 50 and approximately 100 microns, preferably extending at least over the whole working face. The choice of this second material depends on the physicochemical conditions in which the lining will be obliged to work. The said second material may be, for example, a nickel and chromium oxide. It was found that the alloy composed of nickel, chromium, aluminium and yttrium (NiCrAlY) conferred an excellent protection against the corrosium phenomena.

Figure 3:
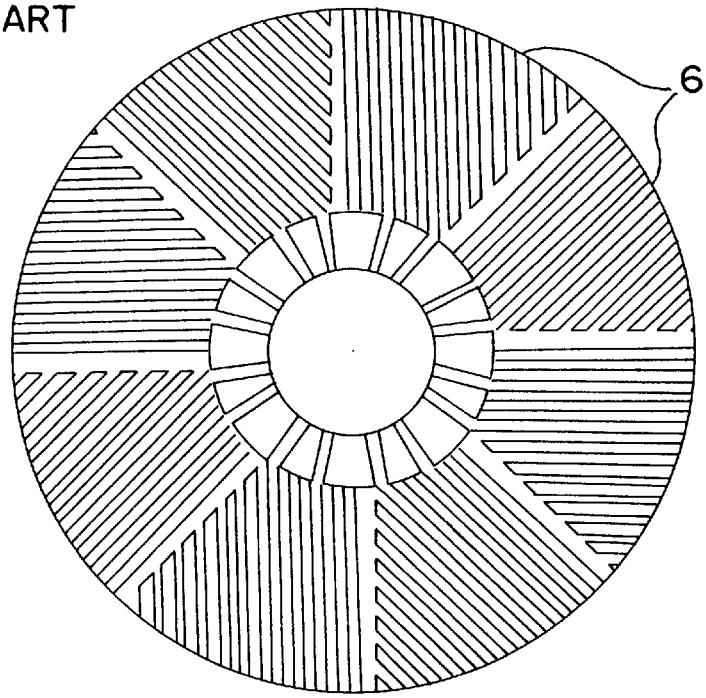
FIG. 3 PRIOR ART
FIG. 3 shows diagrammatically a second refining disc according to the state of the art.
Figure 5:
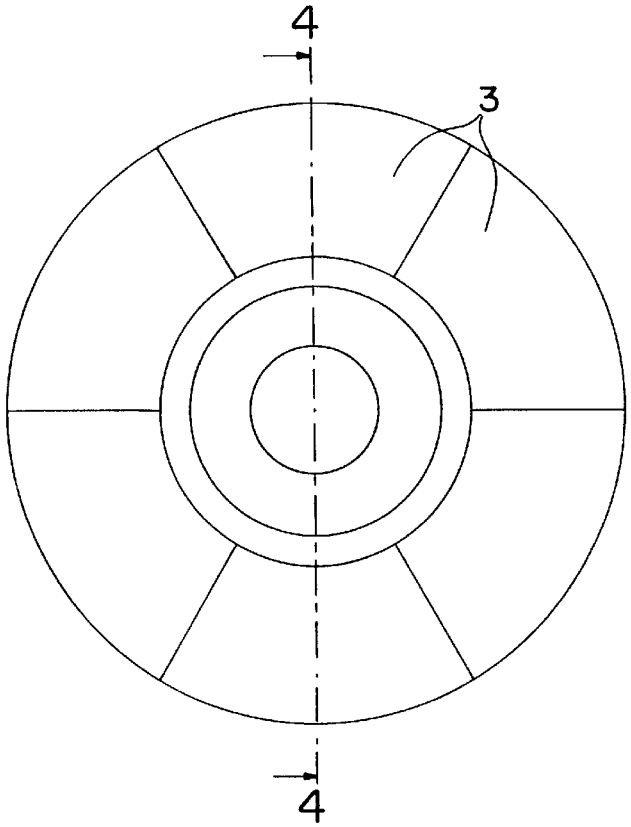
FIG. 5 PRIOR ART
FIGS. 4 and 5 show diagrammatically a conical refiner rotor equipped with refining cones according to the state of the art, seen in front view in cross-section according to the axis 4—4 and in view from the right, respectively.
Figure 4:
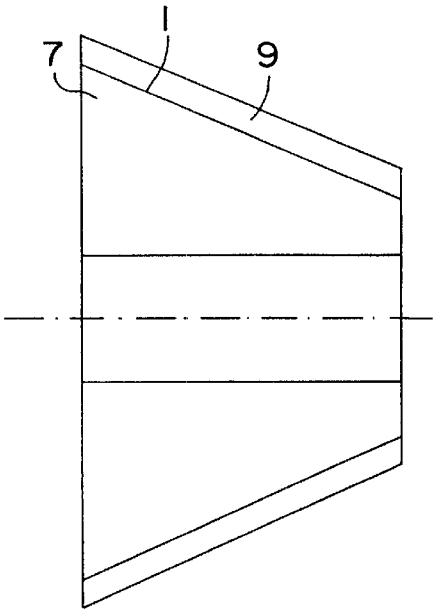
FIG. 4 PRIOR ART
Figure 6:
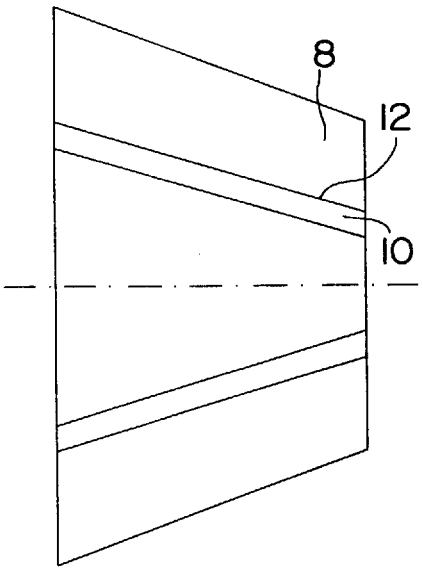
FIGS. 6 and 7 show diagrammatically a conical refiner stator equipped with refining cones according to the state of the art, seen in front view in cross-section according to the axis 6—6 and in view from the left, respectively.
Figure 7:
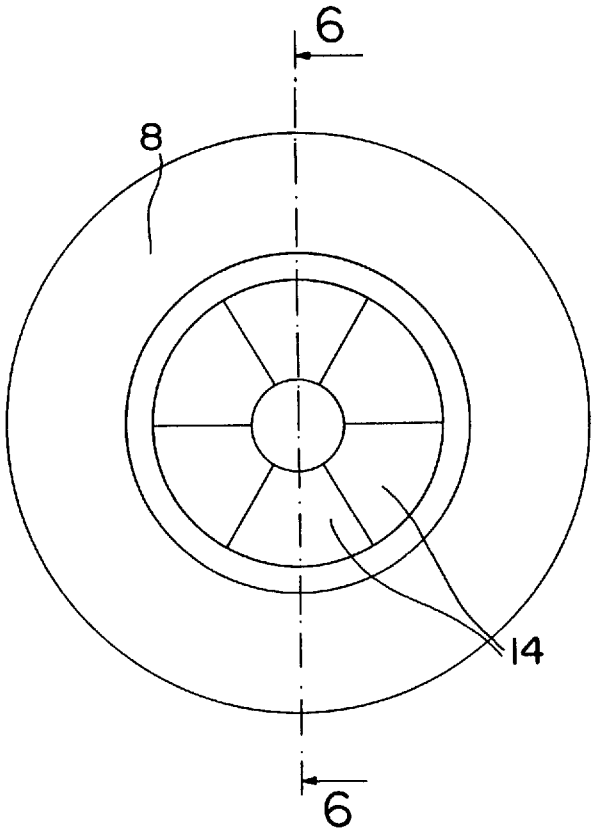

When the lining according to the invention is intended to be employed in a disc refiner, it may take the form of a ring or of a disc like the refining rings or discs of the state of the art which are shown in FIG. 1, or the form of a disc segment like the segments 6 in FIG. 3.

Figure 22:
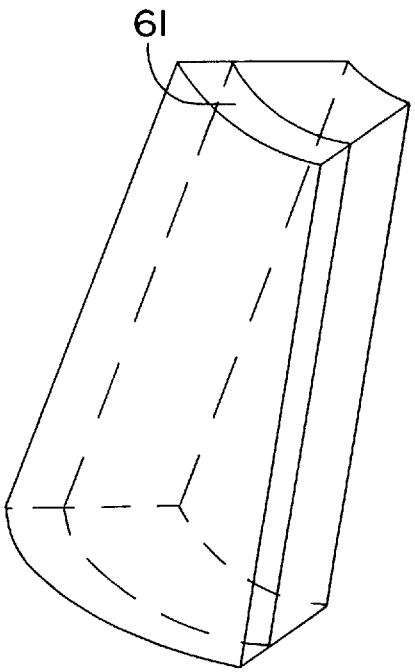
FIG. 22 shows diagrammatically, in perspective, a lining according to the invention, intended to be fitted on a conical refiner rotor block.
Figure 23:
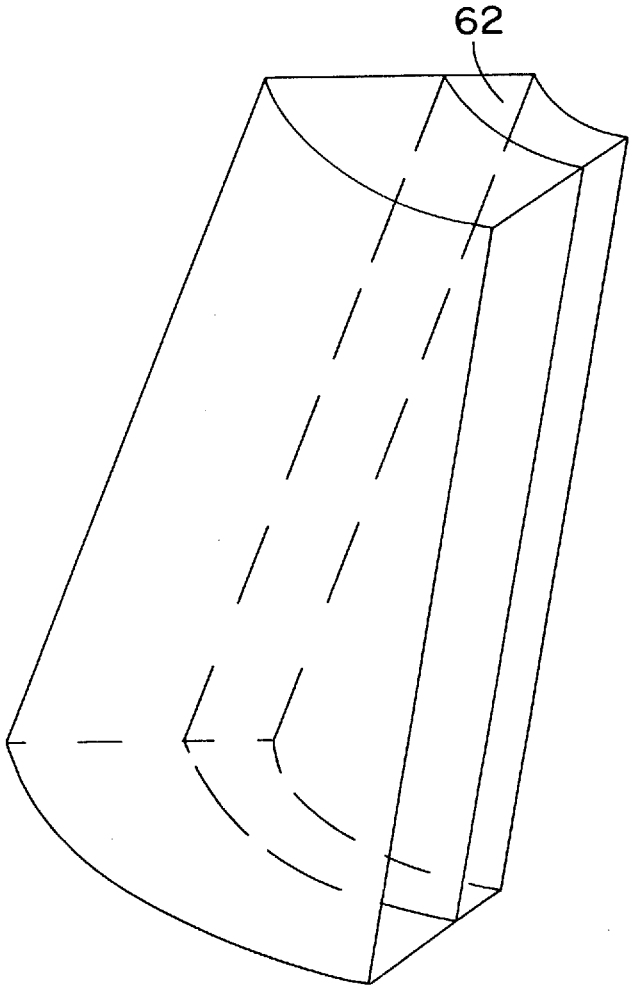
FIG. 23 shows diagrammatically, in perspective, a filling according to the invention, intended to be fitted on a conical refiner stator block.

When the lining according to the invention is intended to be fitted to a conical refiner, it may have a form of a cone or of a conical frustum, or a form of a segment of a cone or of a conical frustum, like those illustrated by FIGS. 22 and 23.

Figure 8:
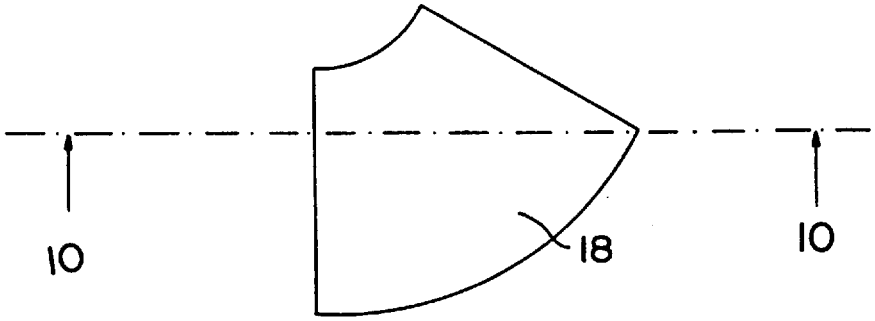
FIGS. 8 and 9 show a filling according to the invention, in front view and in plan view respectively.
Figure 9:
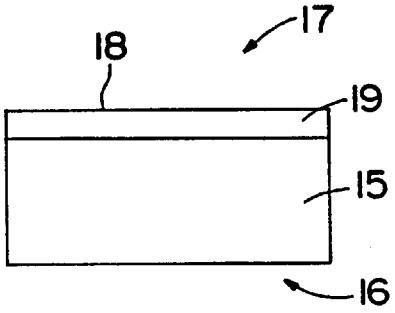

The filling according to the invention, as illustrated by FIGS. 8 and 9, includes a core 15 made of a rigid material comprising a face 16 for securing to the refiner and a working face 17 which is at least essentially planar.

As the working face 17 of the filling is planar, the active surface 18 of the component extends over the whole working face 17.

A coating 19 consisting of a wear-resistant material covers the said core 15 so that at least the whole active surface 18 of the filling consists of the wear-resistant material. The action of fibrillation of the pulp is thus performed only on the wear-resistant material and not on the core 15.

Figure 10:
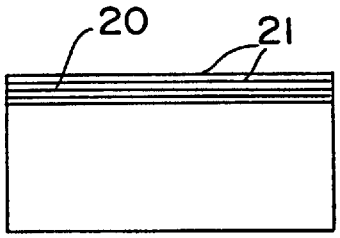
FIG. 10 shows diagrammatically, in section, the filling of FIGS. 8 and 9 in plan view in section according to 10—10.

As can be seen in FIG. 10, the coating 20 consists of at least two thin layers or lamellae 21 placed over one another preferably so as to be at least essentially parallel. These lamellae 21 enable the coating 20 to wear more uniformly and thus contribute to the constancy of the refining conditions. The number of lamellae 21 is preferably the highest possible which the technology employed for producing the coating allows to be obtained. Tests have shown, in fact, that when the coating consisted only of a single layer it could be easily torn away when the rotor was brought close in relation to the stator. The lamellae impart to the coating a particular wearability which enables the fillings to become adapted to the refiner. In the case of a disc refiner, for example, the discs are practically never perfectly parallel. As a result, when the gap is reduced it may happen that contacts take place, in some places, between two discs facing each other. If the coating is made of a single thick layer, it is then very frequently torn away. On the other hand, if the coating is made up of lamellae, only the surface lamellae situated in the places where the contacts have taken place are torn away and the refining can then take place between the remaining lamellae of each of the discs.

The fillings according to the invention may thus exhibit two types of wear resistance:

- a high wear resistance towards the pulp to be refined, due to the nature of the material forming the coating, and this allows slow wear and utilization of the filling for long periods, and
- a low resistance to wear by impact, which permits numerous stoppages and restarts without tearing away of the coating.

Figure 11:
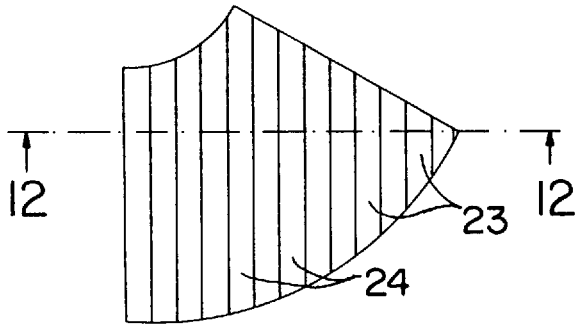
FIGS. 11 and 12 show diagrammatically a first alternative form of the filling according to the invention, in front view and in plan view in section according to the axis 12—12, respectively.
Figure 12:
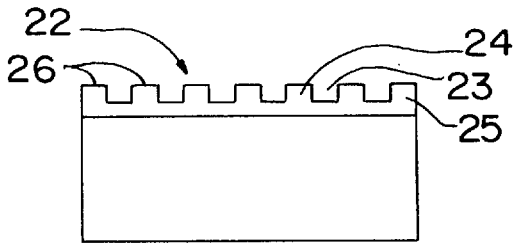

According to a first advantageous alternative form shown in FIGS. 11 and 12, the working face 22 of the filling is provided with one or more grooves 23 alternating with one or more blades 24.

The said grooves 23 are intended to facilitate the pulp flow. They may be of any section. They may, in particular, have a rectangular section, like those encountered on the commercial refining discs. They are present in the coating 25, which extends over the whole working face 22. The active surface of the filling is then the sum of the surfaces of all the tops 26 of the blades 24. The area of the active surface is therefore smaller than the area of the working face 22. The geometry of the blades 24 and grooves 23 may be chosen as a function of the specific type of treatment to which it is desired to subject the material to be refined. The geometry/material pairing of the said coating 25 can be optimized for each specific treatment of the material to be refined.

Figure 13:
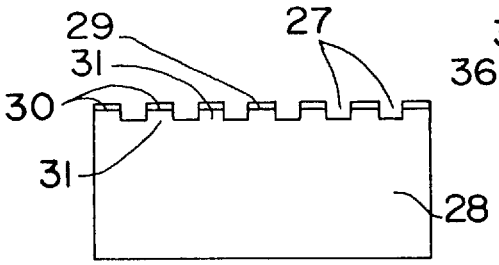
FIG. 13 shows diagrammatically, in section, a second alternative form of the filling according to the invention.

According to a second advantageous alternative form shown in FIG. 13, the grooves 27 are present in the core 28 and the coating 29 covers only the tops 30 of the blades 31. In this case it is preferable that the rigid material forming the core 28 should be a material exhibiting a fairly good wear-resistance, such as the cast iron of the "Ni-hard" type or chromium steels. The latter, in addition, have the advantage of exhibiting a good corrosion resistance.

Figure 14:
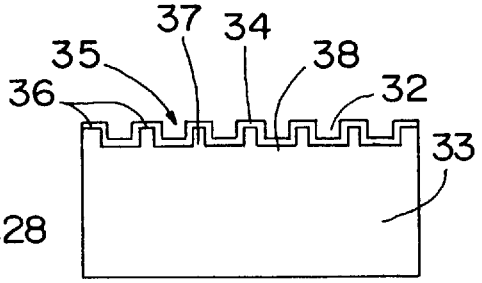
FIG. 14 shows diagrammatically, in section, a third alternative form of the filling according to the invention.

According to a third advantageous alternative form shown in FIG. 14, the grooves 32 are present in the core 33 and the coating 34 occupies the whole working face 35. The coating 34 preferably matches all the shapes of the core 33. It is therefore placed both on the tops 36 of the blades 37 and in their recesses 38. Its thickness is preferably uniform on all the tops 36.

The coating 34 may also be made up of several portions, each consisting of a different material. It is thus possible to cover the tops 36 with a first material and the recesses 38 and the walls of the grooves 32 with a second material. The said first material is then advantageously chosen from the materials exhibiting a high wear resistance and/or good tribological properties, such as alumina, and the said second material is chosen from materials exhibiting a high abrasiveness, such as tungsten carbide, and/or a high corrosion resistance.

Figure 15:
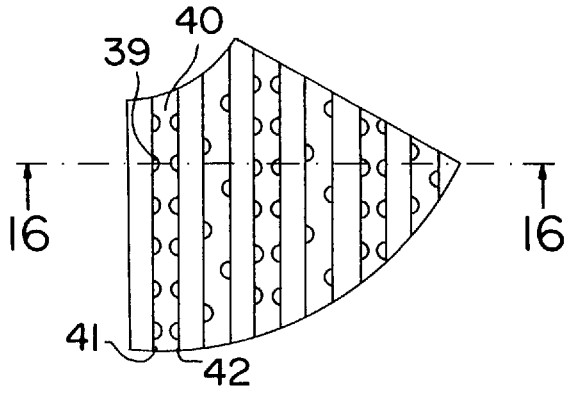
FIGS. 15 and 16 show diagrammatically a fourth alternative form of the filling according to the invention, in front view and in plan view in section according to the axis 16—16, respectively.
Figure 16:
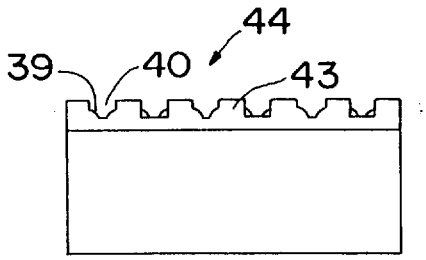

According to a fourth advantageous alternative a form shown in FIGS. 15 and 16, one or more obstacles 39 are placed in one or more grooves 40, so as to produce one or more constrictions and to perturb the circulation of the pulp by creating microvortices inside the grooves 40, the effect of this being to force the material which has to be refined to pass between the active surfaces of the rotor and of the stator. The quality of the refining is then improved.

The exact shape of the said obstacles 39 is of little importance, as long as they make it possible to produce a pulp flow of the turbulent type. This then results in an increase in the residence time of the pulp between the rotor and the stator of the refiner, and it improves the effectiveness of the refining and, consequently, the quality of the pulp obtained.

The said obstacles 39 may be arranged randomly or in groups of two and situated facing one another, on the walls 41 and 42 of the grooves 40 respectively. The obstacles situated on the wall 41 may also be offset in relation to those situated on the wall 42.

The obstacles preferably consist of the same material as the coating 43 with which they are integral.

Since the coating 43 covers the whole working face 44 according to this fifth alternative form, the obstacles 39 are therefore placed both in the grooves 40 and on the coating 43.

When the coating 43 includes a first material for the active surface and a second material in the grooves 40, the obstacles 39 are preferably made of the said second material.

Figure 17:
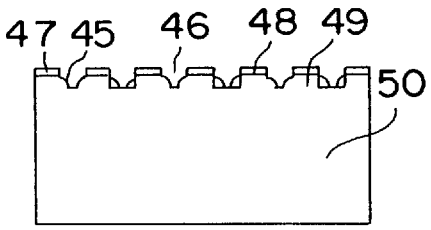
FIG. 17 shows diagrammatically, in section, a fifth alternative form of the filling according to the invention.

According to a fifth advantageous alternative form shown in FIG. 17, the obstacles 45 are placed in the recesses or on the walls of the grooves 46. As the coating 47 covers only the tops 48 of the blades 49, the obstacles 45 are therefore in contact with and adhere to the core 50. They can also form part of the core 50 and can consequently be made of the same material as this core 50.

Figure 18:
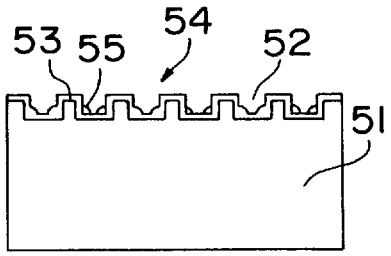
FIG. 18 shows diagrammatically, in section, a sixth alternative form of the filling according to the invention.

According to a sixth advantageous alternative form shown in FIG. 18, the core 51 is provided with grooves 52. The coating 53 covers the whole working face 54. The obstacles 55 are therefore fixed against the coating 53 or form part of the latter, which preferably follows all the shapes of the core 51 and preferably has a thickness which is uniform over the whole working face 54.

Figure 19:
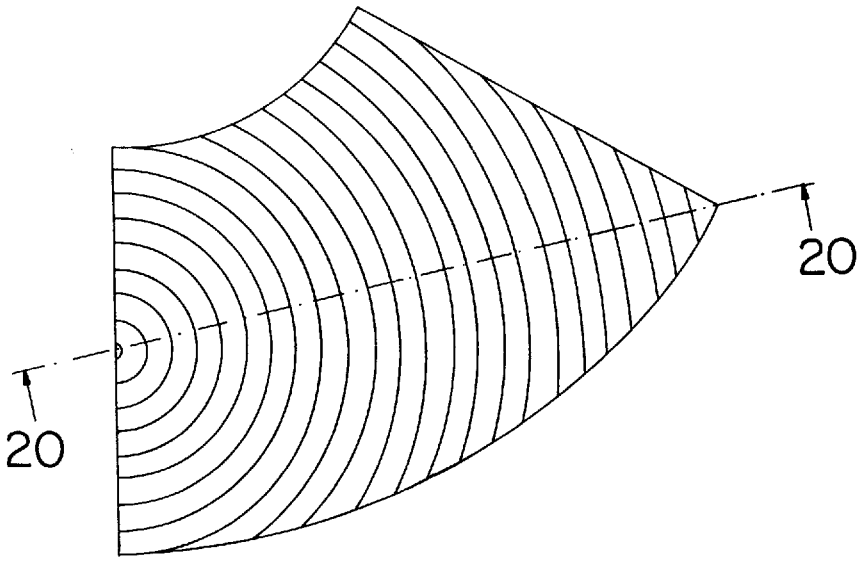
FIGS. 19 and 20 show diagrammatically a seventh alternative form of the filling according to the invention, in front view and in plan view in section according to the axis 20—20 respectively.
Figure 20:
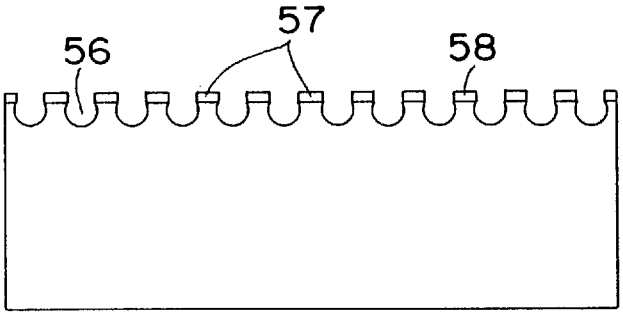

FIGS. 19 and 20 show a seventh advantageous alternative form of the filling according to the invention, in which the grooves 56 have a quasicircular section. Such linings thus have a high active surface (made up of the sum of the surfaces of the tops 57 covered by the coating 58), while exhibiting grooves 56 that can contain a large volume of pulp during the refining.

Figure 21:
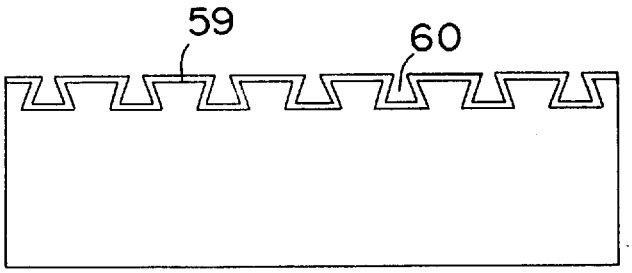
FIG. 21 shows diagrammatically, in section, an eighth alternative form of the filling according to the invention.

FIG. 21 shows an eighth advantageous alternative form of the filling according to the invention, in which the coating 59 covers the whole working face and the grooves 60 have a dovetail shape, and this constitutes another way of achieving a high active surface while having grooves 60 of large volume.

When the lining according to the invention has grooves, a variable depth may be envisaged for these grooves. This depth may, for example, be low at one end (for example, the periphery in the case of an annular filling) and may increase, preferably uniformly, to become great at the other end (the centre in the case of an annular filling), or vice versa. The choice between an increase in depth towards one of the ends, or an increase towards the other end, will then depend on the operating characteristics of the refiner, especially on the direction imposed on the pulp circulation in the refiner.

It may be found advantageous to produce or provide for, in the coating and on its external surface, notches of a depth which is low in relation to the thickness of the coating, so as to create ridges and thus to impart an abrasive character or to increase the abrasive character of the coating.

FIGS. 22 and 23 show fillings according to the invention which are intended to be used on the rotor and on the stator of a conical refiner respectively. When the latter is in operation, the raw material is fibrillated between the coatings 61 and 62 of the fillings, which are pressed against one another.

The filling according to the invention and its alternative forms are intended to be secured, in a known manner, to the rotor block or to the stator block of a refiner. This is why they may comprise one or more holes (not shown) passing through the core and optionally the coating while connecting the working face to the securing face, and which are intended as passages for screws for securing to the rotor block or the stator block of the refiner.

Preparation of the linings according to the invention:

The fillings according to the invention can advantageously be prepared from a core made of a rigid material which is covered at least partially with the aid of a wear-resistant coating in such a way that at least the active surface of the filling consists of all or a portion of the external surface of the said coating.

The covering is performed according to any process that makes it possible to deposit a hard coating on a substrate, like, for example, the process called laser-cladding, the plasma deposition process using thermal spraying, the deposition process using plasma induction or the CVD (Chemical Vapour Deposition) plasma deposition process. The core is preferably provided with grooves which may be produced by machining into a planar core or may be provided for when the core is moulded, especially in the case where it is found more economical to manufacture the latter by moulding.

The core may advantageously be a disc or a segment of a commercial refining disc, or a cone, a conical frustum or a segment of a cone or of a commercial refining conical frustum. The coating of wear-resistant material is then preferably applied so that all the shapes of the commercial disc, disc segment, cone, conical frustum or segment of a cone or of a conical frustum are preserved.

It is obvious that the coating may completely cover the core, that is to say its working face as well as its securing face or its side faces.

A filling according to the invention is thus available which produces better refining than the commercial disc, disc segment, cone, conical frustum or segment of a cone or of a conical frustum. The lining according to the invention thus obtained also has a better wear resistance than the commercial disc, disc segment, cone, conical frustum or segment of a cone or of a conical frustum. In addition, it can be regenerated once it is worn.

Furthermore, when the coating is present in the grooves (first, third, fourth, sixth and eighth alternative forms) and if this coating is abrasive, the turbulent nature of the flow is increased, which is reflected in a better maintaining of the pulp film between the rotor and the stator of the refiner, in better refining and in better control of the entire refining operation.

It is preferable to provide the core with the coating made of wear-resistant material by making use of the so-called plasma deposition process. In fact, when the core comprises grooves a continuous coating is thus obtained which is also uniform in thickness and closely matches all the shapes of the working face. In addition, as the grains forming the starting material have at least partially melted when passing through the flame, the coating obtained is in a form which is continuous, uniform and of relatively high density.

Difficult and costly machining of projections in the wear-resistant material is thus also avoided.

Furthermore, the Applicant Company found in the course of its tests that, despite the large forces involved in the refining, the coating deposited by the plasma process was not torn away.

In addition, the plasma deposition process is found to be particularly advantageous for producing a coating made up of an overlay or stacking of thin layers or lamellae. In fact, this process makes it possible to perform the deposition of the coating in a number of runs, by depositing each time a very small quantity of the wear-resistant material, so as to obtain a coating consisting of an overlay of thin layers or lamellae. Such a coating then wears uniformly and exhibits a surface which has maximum planarity throughout its wear.

The thickness of the lamellae may thus be between 0.003 and 0.100 mm. It is preferably between 0.005 and 0.025 mm.

Another advantage of the use of the plasma deposition process is that a sophisticated and expensive material can be employed as coating, because this process makes it possible to deposit thin layers of material and therefore a small quantity of material, and this does not result in a considerable increase in the cost price of the lining.

Yet another advantage of the plasma deposition process is that the coating deposit can be produced precisely. This process therefore lends itself well to the production of fillings according to the invention such as, for example, those corresponding to the second, fourth, fifth, sixth, seventh or eighth alternative form.

The starting material for making use of the plasma process generally has a particle size of between approximately 10 and approximately 80 microns ($\mu$m) and preferably between approximately 30 and approximately 40 microns ($\mu$m).

The obstacles shown in FIGS. 16, 17 and 18 can be placed using the plasma process.

To obtain a filling whose working face comprises blades and grooves and in which only the tops of the blades are covered with coating, it is possible to obstruct the grooves with the aid of covers, to deposit the coating on the said tops and then to remove the covers. The walls of the grooves are then devoid of coating.

Use of the linings according to the invention:

The filling according to the invention is secured in a known manner, for example by means of screws, to the rotor block or the stator block of the refiner.

The Applicant Company has noticed that the use of the fillings according to the invention makes it possible to keep a constant gap during the refining even when the refining power is very high, and this has the advantage of producing a stability of the refining conditions and maintaining the quality of the refined pulp with time.

In addition, the refined pulp is of a brightness that is superior to that obtained with the fillings according to the state of the art.

The filling according to the invention may be secured to the rotor block or to the stator block of the refiner. It preferably covers the whole working face of the rotor block or of the stator block. The whole active surface of the block thus has a coating of wear-resistant material.

It is possible, of course, to arrange a number of fillings of equal or different dimensions on the rotor block or on the stator block, especially if it is desired to cover the whole working face of the rotor or stator and when the dimensions of a single fillings are insufficient to enable it by itself to occupy the whole working face of the rotor block or of the stator block.

It is preferable to provide both the rotor and the stator of the refiner with one or more fillings according to the invention. It is still more preferable to cover the whole working face of the rotor block and the whole working face of the stator block with one or more fillings according to the invention, so that the whole active surface of the refiner consists of the wear-resistant material. A flow of the pulp to be refined which has a maximum turbulence and optimal refining is then obtained.

The fillings according to the invention can be used with a view to the defibring and/or refining of any material made up of fibres, such as pulps, and in particular paper pulps whose solids content is lower than 60% and preferably lower than 25%. They are found to be particularly effective when the paper pulp to be refined is an aqueous suspension the concentration of which is between 3 and 8%.

The fillings according to the invention make it possible to obtain results which are better, where the cut of the fibres is concerned (fewer cutting phenomena), than those of the linings of the state of the art. It is therefore advantageous to use them in the paper recycling industry. In fact, since they can be employed for refining waste paper, that is to say to improve its quality, they permit a reduction in the long (new) fibre content of recycled paper. In addition, they improve the dispersion of the "stickies", impurities in the paper, and this makes it possible to obtain a paper comprising fewer dark stains. A reduction in the cost of recycling is therefore obtained by virtue of the linings according to the invention.

In addition, the linings according to the invention can be employed for carrying out on disc refiners refining operations which were hitherto possible in practice only on conical refiners, more particularly on wide-angle conical refiners. Such refining operations are those necessary for the preparation of special papers such as cigarette papers, tracing papers, and the like, that is to say papers obtained from pulps of high Schopper-Riegler degree (higher than 60 degrees).

Furthermore, the linings according to the invention can moreover be employed for defibring any cellulosic matter, such as wood scrap, so-called "annual" plants (bagasse, sorghum, alfa, etc.).

Comparative tests

Refining of a paper pulp was carried out in the same conditions, with 4 metal discs according to the state of the art and with 4 linings according to the invention. The discs according to the state of the art were crown rings 16 inches in diameter marketed by the Black-Clawson company, consisting of so-called "Ni-hard" cast iron which had 10 sectors, tops of blades approximately 5.5 mm in width and mutually parallel grooves inside each sector, which were inclined at approximately 20° relative to the radius, of rectangular cross-section, approximately 5.0 mm in width and approximately 6.0 mm in depth. The fillings according to the invention were linings prepared by the plasma spraying deposition process, by covering with a uniform or virtually uniform thickness of approximately 500 $\mu$ (microns) of 97/3 alumina/titanium oxide (97% $Al_2O_3$—3% $TiO_2$) the whole working face of crown rings which were identical with those described above. The coating consisted of an overlay of 25 thin layers, each 20 $\mu$ in thickness. The porosity was of the open type and equal to 20% (measured according to the alcohol penetration test).

The refiner employed was the Twin Midjet refiner marketed by the Black-Clawson company, comprising 4 support discs and operating in duo-flow, that is to say that the 4 support discs are arranged parallel to one another and a portion (theoretically half) of the raw material is refined between 2 refining discs of a first set and the other portion between 2 refining discs of a second set. The raw material was introduced at the centre of the refining disc. The refined pulp came out at the periphery of the discs.

The refiner was equipped with a 140 kW power motor.

The nominal pulp travel flow rate was from 30 to 40 $m^3$/h, the maximum flow rate being 60 $m^3$/h.

Figure 24:
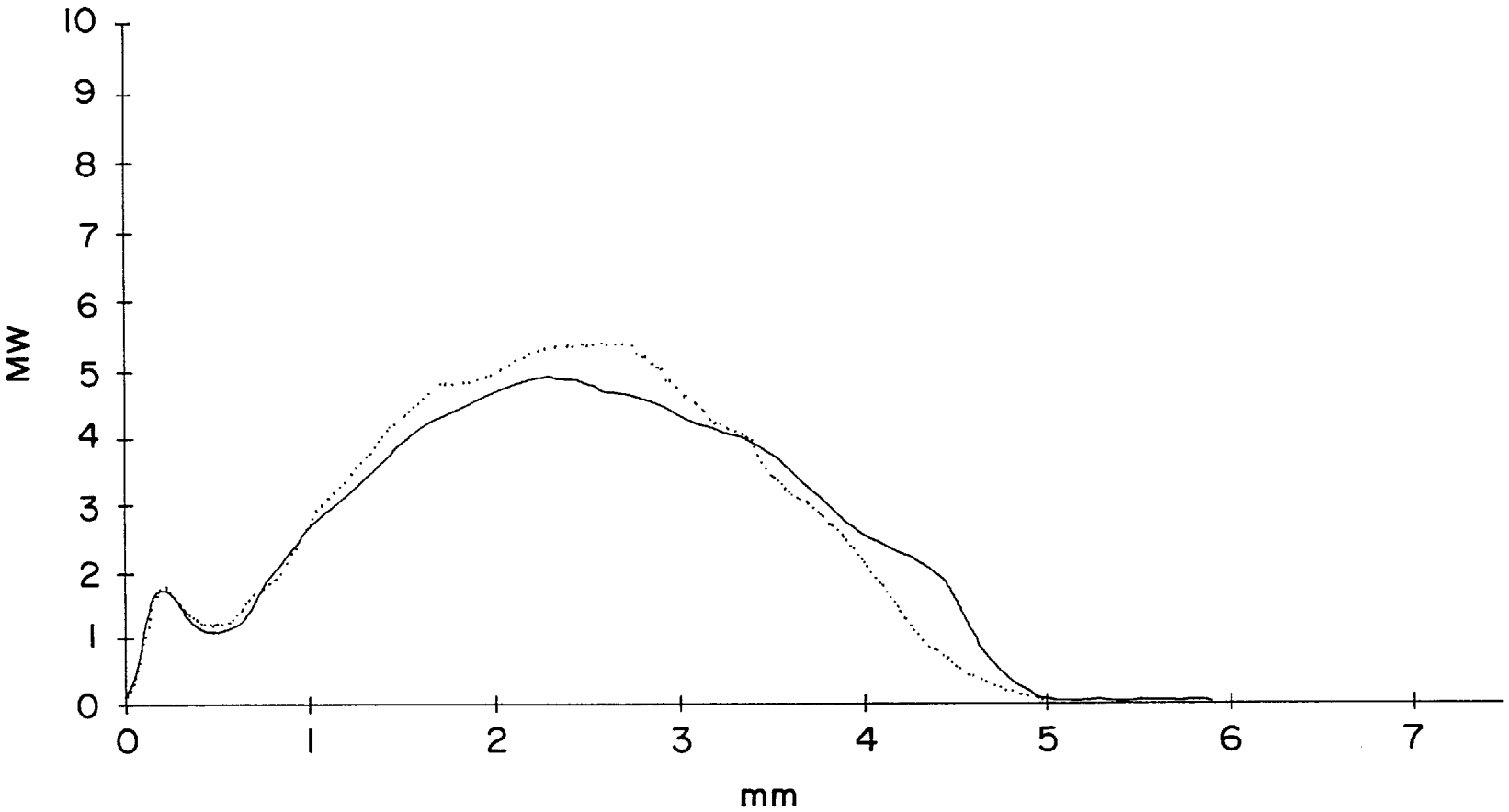
FIG. 24 shows the curve of weighted length of the fibres of a raw material before refining.

The raw material had a concentration of 3% and consisted of so-called chemical coniferous paper pulp of Scandinavian origin. FIG. 24 shows the curve of weighted lengths of the fibres and of the fillings making up the raw material. The mean fibre length, measured by an optical sensor, was 2.49 mm. The mass percentage of the fibres as a function of their length is shown above the curve.

The superiority of the linings according to the invention is evaluated through measurements performed on paper former sheets prepared from refined pulp. The results of these measurements are rearranged in the Tables A, B, C and D, which follow, in which:

'E.T.' denotes the former sheets obtained from pulp refined in a refiner fitted with 4 commercial discs, 'INV.' denotes the former sheets obtained from pulp refined in a refiner fitted with 4 linings according to the invention.

The measurements were performed in accordance with the French standards shown in the tables, in an atmosphere conditioned at 65% RH and at 20° C.

$BL_0$ is the breaking length calculated from the tensile strength with abutting clamps, while BL is the breaking length according to AFNOR standard Q03004.

The column '°SR' indicates the Schopper-Riegler degree of the refined pulp.

TABLE A

| Refining time | Weight ($g/m^2$) NFQ03-019 | | Thickness ($\mu$m) NFQ03-016 | | °SR NFQ50-003 | |
|---|---|---|---|---|---|---|
| (min) | E.T. | INV. | E.T. | INV. | E.T. | INV. |
| 0 | 67.4 | 67.4 | 121 | 121 | 15 | 15 |
| 5 | 64 | 72.6 | 105 | 126 | 23 | 22 |
| 10 | 63.5 | 74 | 99 | 119 | 39 | 35 |
| 15 | 64 | 73.6 | 95 | 108 | 52 | 54 |
| 20 | 66 | 74 | 92 | 101 | 66 | 71 |
| 25 | | 72 | | 90.4 | | 79 |

TABLE B

| Refining time | Brightness (%) NFQ03-038 | | Corrected opacity (in % at 70 $g/m^2$) NFQ03-006 | |
|---|---|---|---|---|
| (min) | E.T. | INV. | E.T. | INV. |
| 0 | 83.8 | 83.8 | 76.3 | 76.3 |
| 5 | 81.1 | 82.1 | 75.9 | 75 |
| 10 | 79.4 | 81.7 | 75.8 | 75.3 |
| 15 | 74.6 | 80 | 75.6 | 69.7 |
| 25 | | 78.4 | | 66.7 |

TABLE C

| Refining time | Id 100 (mN $m^2$/g) NFQ03-011 | | Burst I (kPa $m^2$/g) NFQ03-053 | | BL (m) NGQ03-004 | | Elongation at break (%) | |
|---|---|---|---|---|---|---|---|---|
| (min) | E.T. | INV. | E.T. | INV. | E.T. | INV. | E.T. | INV. |
| 0 | 1151 | 1151 | 2.59 | 2.59 | 3549 | 3549 | 3.05 | 3.05 |
| 5 | 1131 | 1368 | 3.51 | 3.85 | 4923 | 5397 | 3.715 | 3.3 |
| 10 | 1046 | 1438 | 3.97 | 4.71 | 5638 | 6669 | 3.99 | 3.69 |
| 15 | 875 | 1210 | 4.09 | 5.43 | 6202 | 7662 | 3.97 | 3.74 |
| 20 | 830 | 962 | 4.33 | 5.35 | 6830 | 7873 | 4.2 | 3.79 |
| 25 | | 853 | | 5.65 | | 8796 | | 3.72 |

TABLE D

| Refining time | Permeability [$cm^3/(m^2$ Pa s)] NFQ03-061 | | $Bl_0$ dry (m) NFQ03-056 | | $Bl_0$ wet (m) NFQ03-056 | |
|---|---|---|---|---|---|---|
| (min) | E.T. | INV. | E.T. | INV. | E.T. | INV. |
| 0 | 82.4 | 82.4 | 11171 | 11171 | 10480 | 10480 |
| 5 | 29.5 | 21.5 | 11767 | 11485 | 10418 | 9547 |
| 10 | 14.7 | 5 | 11800 | 11966 | 9369 | 9754 |
| 15 | 4.16 | 1.26 | 11988 | 11755 | 9189 | 9547 |
| 20 | 2 | 0.25 | 11190 | 12040 | 8090 | 8554 |
| 25 | | 0.07 | | 11560 | | 8164 |

According to the results in these tables it appears therefore that the hydration and the fibrillation of the pulp take place without an appreciable phenomenon of fibre cutting being observed.

Figure 25:
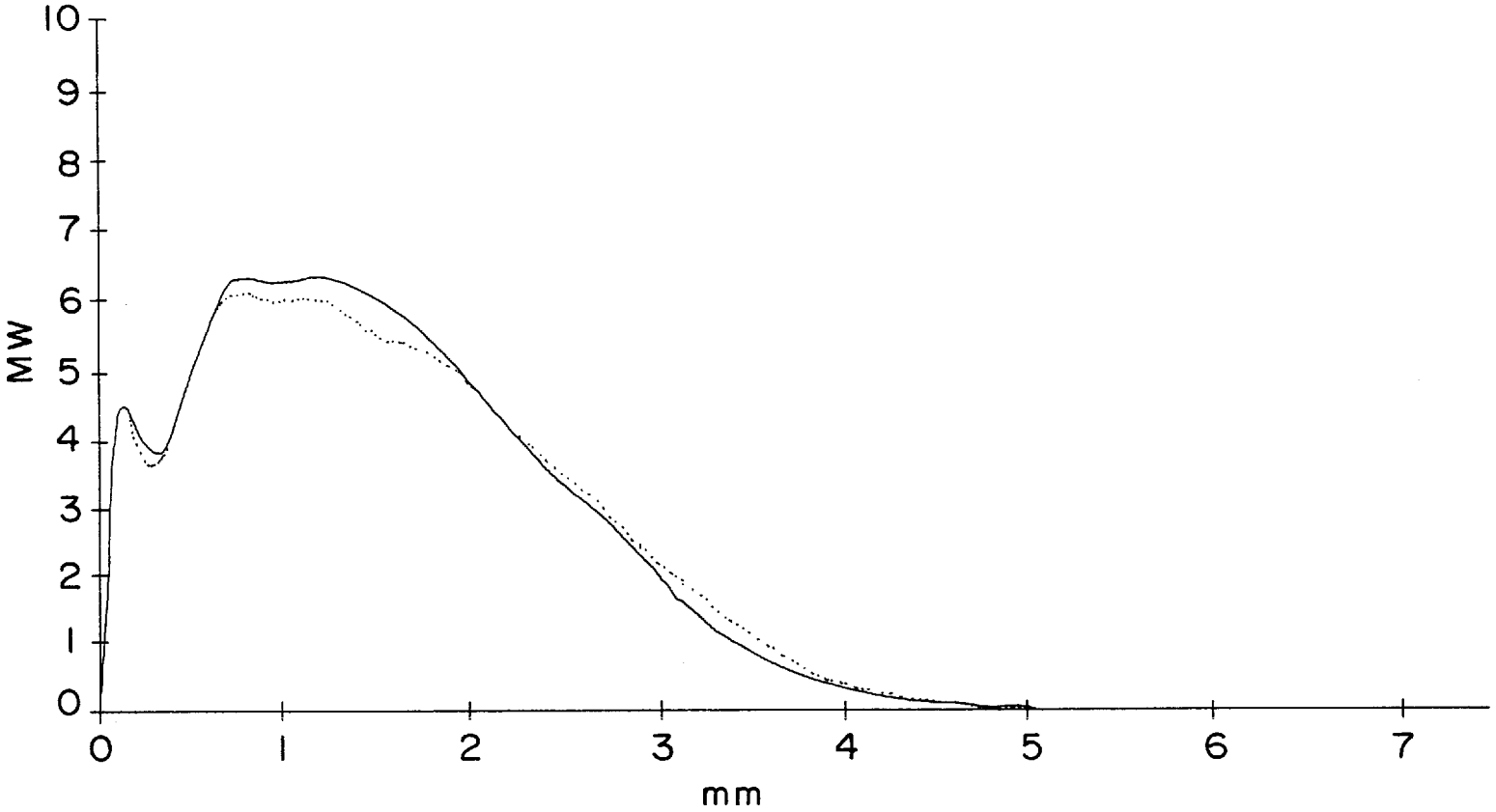
FIG. 25 shows the curve of weighted length of the fibres of a pulp obtained after refining with the discs according to the state of the art.

FIG. 25 shows the curve of weighted length of the fibres and of the components making up the pulp after refining for 20 minutes with the discs according to the state of the art and with an effective power of 40 kW. The mean fibre length was 1.55 mm.

Figure 26:
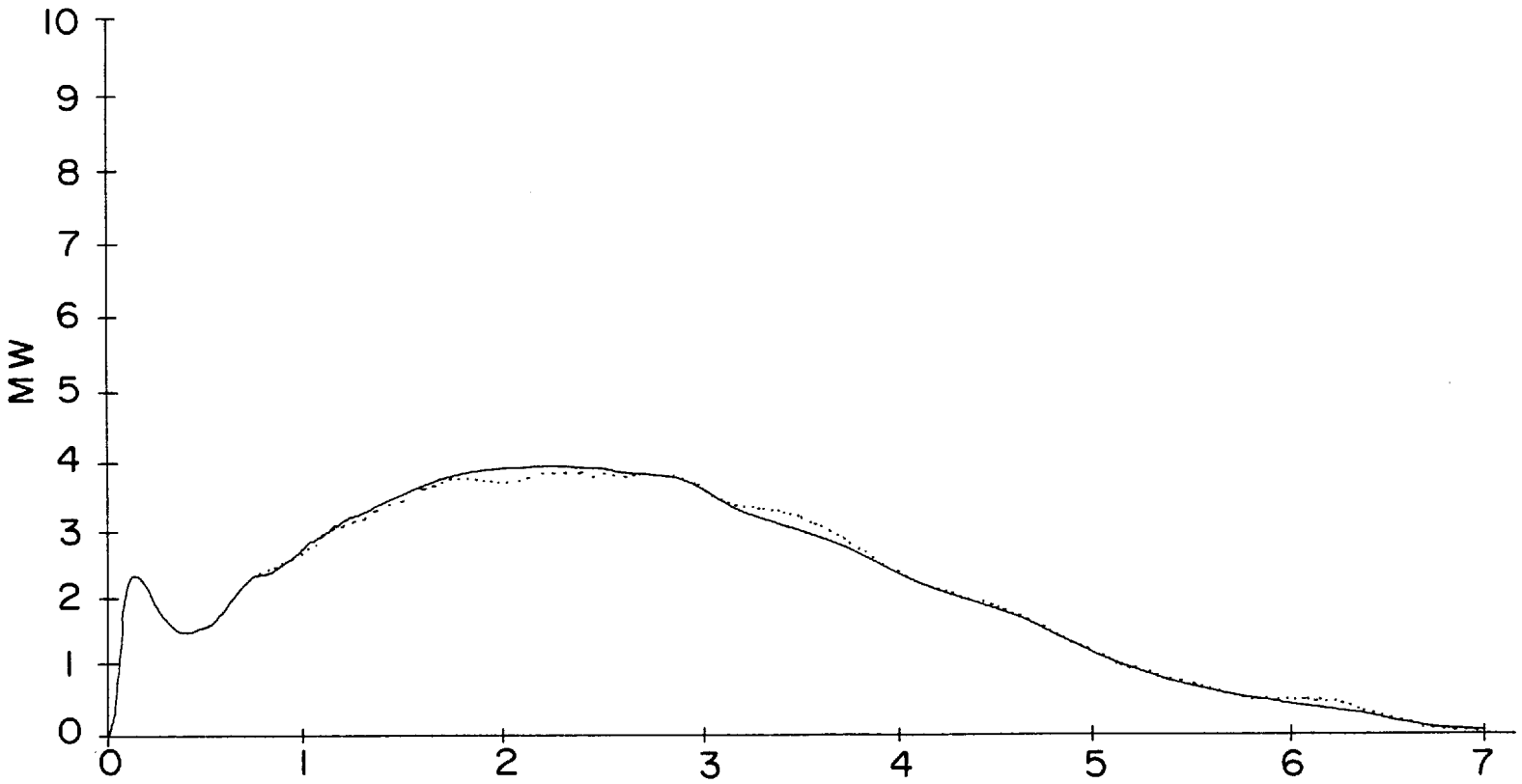
FIG. 26 shows the curve of weighted length of the fibres of a pulp obtained after refining with fillings according to the invention.

FIG. 26 shows the curve of weighted length of the fibres and of the components making up the pulp after refining for 20 minutes with the linings according to the invention, also with a power of 40 kW. The mean fibre length was 2.66 mm.

Figure 27:
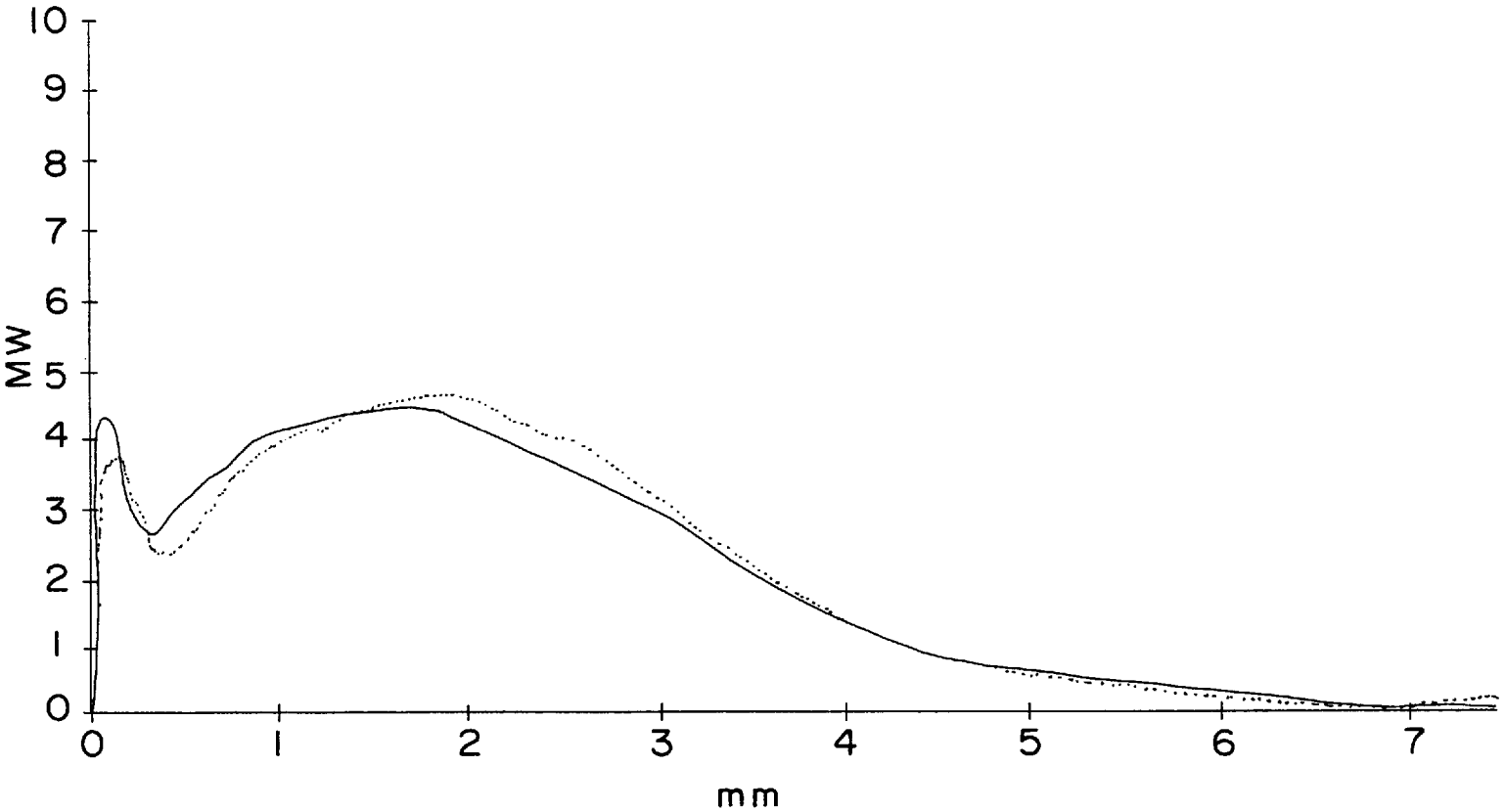
FIG. 27 shows another curve of weighted length of the fibres of a pulp obtained after refining with fillings according to the invention.

FIG. 27 shows the curve of weighted length of the fibres and of the components making up the pulp after refining for 25 minutes with the linings according to the invention, with a power of 60 kW. The mean fibre length was 2.18 mm.

These curves clearly show that the linings according to the invention make it possible to obtain a reduction in the fibre cutting phenomenon and a decrease in the production of fines.

Mechanical tests performed using comparisons on paper former sheets manufactured from refined pulp demonstrate that the breaking length and the burst ratio of the paper obtained with the linings according to the invention are on average approximately 15 to 20% higher than those of the paper obtained with the discs of the state of the art. A superiority of approximately 30% was even obtained when the effective power applied was 60 kW. In this context it is appropriate to note that when discs according to the state of the art are used it is impossible to apply an effective power which is as high as this in the specific operating conditions of the plant employed for testing the linings according to the invention.

Astonishingly, it was also found that the tear value increases at the beginning of the refining with the fillings according to the invention, whereas, as a general rule, the tear value of the former sheets decreases from the beginning of the refining operation with discs according to the state of the art.

Other tests conducted by the Applicant Company on industrial plants have made it possible to observe a reduction of 10 to 15% in the No-load empty power of the refiner during the use of the fillings according to the invention, compared with the No-load power needed with the cast iron filling of the state of the art. A No-load power is here intended to mean the mechanical and hydraulic power employed for circulating the pulp through the refiner.

In addition, the Applicant Company has found, with satisfaction, that when the refiner was fitted with the fillings according to the invention it was much less noisy than when it comprised the cast iron linings of the state of the art.

Quite obviously, the invention is not limited in any manner by the specific features which have just been described or by the details of the figures and of the tests presented to illustrate it. Various modifications can be introduced into the shapes of the particular linings which have been described by way of illustration and into their constituent components without departing thereby from the scope of the invention. The latter consequently encompasses all the means which constitute technical equivalence of the means described and their combination.

We claim:

1. A pulp refiner filling, comprising a face (16) for securing to a refiner and a working face (17, 22) comprising an active surface and including at least one core (15, 28, 33, 50, 51) made of rigid material covered by a coating made of a wear-resistant material in such a way that at least the active surface (18) of the filling is comprised of all or a portion of the external surface of said coating (19, 20, 25), characterized in that said coating (19, 20, 25) is porous and is comprised of an overlay of thin layers or lamellae (21), characterized in that the thickness of said thin layers or lamellae (21) is between 0.003 and 0.100 mm.

2. A filling according to claim 1, characterized in that the porosity of said coating (19, 20, 25) increases from the core (15, 28, 33, 50, 51) towards said active surface (18).

3. A filling according to claim 1, characterized in that said working face (17, 22) is provided with at least one groove (23, 40, 46) intended to facilitate the flow of the pulp to be refined.

4. A filling according to claim 3, characterized in that said groove or grooves (23, 40, 46) are present in said core (15, 28, 33, 50, 51).

5. A filling according to claim 3, characterized in that at least one obstacle (39, 45, 55) intended to perturb the flow of the pulp is placed in at least one of said grooves (23, 40, 46).

6. A filling according to claim 1, characterized in that said coating (19, 20, 25) covers the whole said working face (17, 22).

7. A filling according to claim 1, characterized in that said rigid material is chosen from the group consisting of metals, metal alloys, cast iron and plastics.

8. A filling according to claim 1, characterized in that said wear-resistant material is a ceramic.

9. A filling according to claim 1, characterized in that the thickness of the coating is between 0.1 and 2 mm.

10. Filling according to claim 9, characterized in that the thickness of the coating is between 0.5 and 0.8 mm.

11. Filling according to claim 1, characterized in that thickness of the said thin layers or lamellae (21) is between 0.005 and 0.025 mm.

12. Filling according to claim 1, characterized in that the ratio—total volume of the pores/total volume of the coating—is between 10% and 30%.

13. Filling according to claim 12, characterized in that the coating comprises alumina.

14. A disc or conical refiner comprising a filling, said filling comprising a face (16) for securing to the refiner and a working face (17, 22) comprising an active surface and including at least one core (15, 28, 33, 50, 51) made of rigid material, covered by a coating (19, 20, 25) made of a wear-resistant material in such a way that at least the active surface (18) of the filling is comprised of all or a portion of the external surface of said coating (19, 20, 25), characterized in that said coating (19, 20, 25) is porous and is comprised of an overlay of thin layers or lamellae (21), characterized in that the thickness of said thin layers or lamellae (21) is between 0.003 and 0.100 mm.

15. In a process comprising refining pulp, the improvement wherein said refining is conducted by passing the pulp through a refiner according to claim 12.

16. A process according to claim 15, for refining a paper pulp.

17. A process of manufacturing a pulp refiner filling as claimed in claim 1 comprising depositing the coating (19, 20, 25) in a number of runs so as to obtain a coating (19, 20, 25) comprising an overlay of thin layers or lamellae (21), the thickness of said thin layers or lamellae (21) being between 0.003 and 0.100 mm.

18. Process according to claim 17, characterized in that the coating (19, 20, 25) is exposited by a plasma spraying deposition process.

19. A process according to claim 17, characterized in that the thickness of said thin layers or lamellae (21) is between 0.005 and 0.025 mm.

* * * * *